United States Patent [19]

Benedicenti

[11] Patent Number: 4,674,998

[45] Date of Patent: Jun. 23, 1987

[54] FORMING ASSEMBLY FOR AUTOMATIC MACHINES FOR FORMING BOXES FROM SEMI-FINISHED FLAT BLANKS

[75] Inventor: Pio Gabriele Benedicenti, Chieri, Italy

[73] Assignee: Cartotecnica Chierese S.p.A., Chieri, Italy

[21] Appl. No.: 875,050

[22] Filed: Jun. 17, 1986

[30] Foreign Application Priority Data

Jun. 21, 1985 [IT] Italy ..... 67580 A/85

[51] Int. Cl.[4] ..... B31B 3/06; B31B 3/32; B31B 3/44

[52] U.S. Cl. ..... 493/164; 493/124; 493/127; 493/171; 493/474; 493/476

[58] Field of Search ..... 493/123, 124, 127, 143, 493/144, 164, 167, 172, 175, 449, 474, 476

[56] References Cited

U.S. PATENT DOCUMENTS

| | | | |
|---|---|---|---|
| 3,053,151 | 9/1962 | Blumer | 493/167 |
| 3,260,174 | 7/1966 | Pierle | 493/167 |
| 3,800,681 | 4/1974 | Corderoy | 493/167 |
| 3,815,483 | 6/1974 | Cato | 493/123 |
| 3,941,037 | 3/1976 | Reichert | 493/167 |
| 4,500,306 | 2/1985 | Nowacki | 493/143 |
| 4,522,618 | 6/1985 | Stannard | 493/143 |

FOREIGN PATENT DOCUMENTS

| | | | |
|---|---|---|---|
| 1935243 | 1/1971 | Fed. Rep. of Germany | 493/167 |
| 1372583 | 8/1964 | France | 493/167 |
| 373946 | 12/1963 | Switzerland | 493/167 |

*Primary Examiner*—Frederick R. Schmidt
*Assistant Examiner*—William E. Jerrell
*Attorney, Agent, or Firm*—Sughrue, Mion, Zinn, Macpeak and Seas

[57] ABSTRACT

A forming assembly for automatic machines for forming boxes from semi-finished flat blanks, comprises a plate support with associated suction means for the semi-finished blanks and a forming mould for the erection of the parts of the semi-finished blank intended to constitute the side walls of the box.

The forming mould has simplified longitudinal and transverse forming elements which are adjustable in length, width and height, and the plate support has spring feet supported by modular blocks releasably fixed to the sides of the plate. The plate support also has suction members connectible by a system of external tubing to a vacuum source.

5 Claims, 10 Drawing Figures

Figure 1:
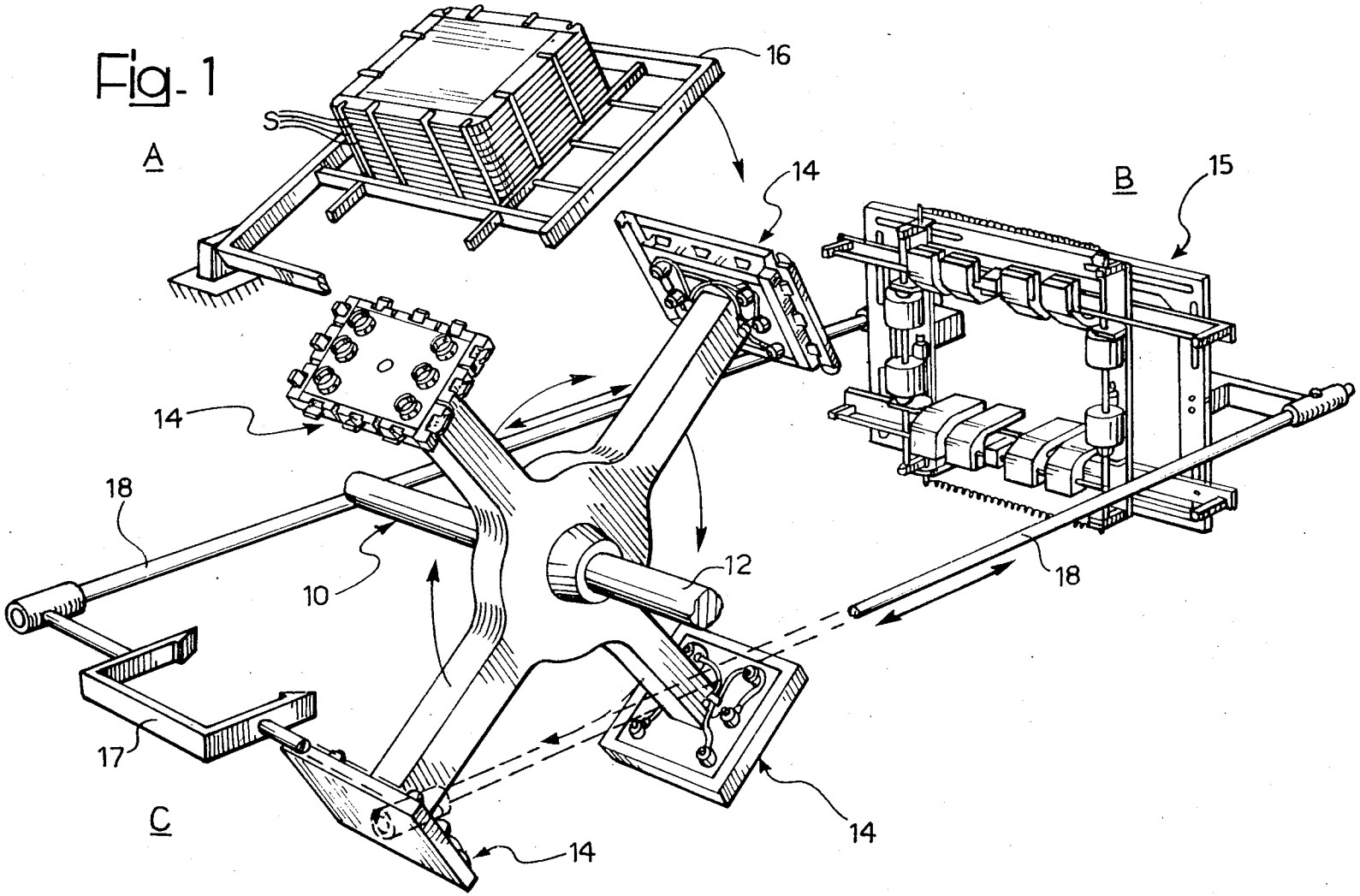

FORMING ASSEMBLY FOR AUTOMATIC MACHINES FOR FORMING BOXES FROM SEMI-FINISHED FLAT BLANKS

The present invention relates in general to automatic machines for forming boxes from semi-finished flat pieces or blanks.

More particularly the invention relates to automatic machines for forming boxes with side walls in the form of tubular frames, of the type in which the semi-finished pieces are withdrawn from the bottom of a pile contained in a magazine and taken one by one by suction for transfer to a forming station where the parts of the semi-finished piece intended to constitute the side walls of the box are bent at a right angle and raised relative to the part which will constitute the bottom. This forming operation is achieved by means of a forming assembly including a plate support by means of which the semi-finished products are taken from the magazine and transferred to the forming station, and a forming mode located at the forming station and movable perpendicular to the plate support when the latter has finished its movement for transferring the semi-finished products from the magazine to the forming station. This movement may be along an arc of a circle and in this case the plate support is carried by a rotatable rotor as in the case of the machine produced and sold by the German company Schubert under the trade name SKA or along a linear path as in the case of the machine described in U.K. Pat. No. 1536173 in the name of the applicant.

In the machine described and illustrated in the aforesaid U.K. patent, the plate support includes a rectangular support slab to the sides of which are attached sprung feet adapted to cooperate with the bottom of the semi-finished product during the forming of the boxes, and the forming mould includes a rectangular base frame supporting two longitudinal bars carrying shaped segments for forming the longitudinal walls of the mould, the longitudinal bars being adjustable transverse the frame and the shaped segments being adjustable along the longitudinal bars, and two transverse bars carrying elements for forming the side walls of the mould and two transverse shafts carrying respective presser rollers movable away from each other against the action of resilient biassing means, the transverse bars and the transverse shafts being adjustable longitudinally of the frame.

In this known forming assembly, the sprung feet of the plate support are attached directly and hence permanently to the sides of the support slab and the suction means are constituted by simple suction openings formed in one face of the slab and interconnected by a system of channels within the slab for connection to a suction device. In the forming mould of this known assembly, the base frame is fixed to a cross support by means of which it is connected to the drive members of the machine, and the said shaped segments are attached directly to the longitudinal bars and include a series of segments having different shapes. The transverse members of the forming mould are also constituted by differently shaped segments supported directly by the transverse bars.

This arrangement has the disadvantage that the forming assembly is difficult to adapt to the assembly of boxes having different dimensions so that it is necessary in practice to provide a vast range of different forming moulds and relative complementary plate support, with obvious problems of cost and bulk for storage. There is in fact a possibility of adapting the forming mould to the assembly of boxes of different lengths and widths but this requires changing a very large number of components which consequently takes a long time and involves difficulties. It is not in any case possible to adapt the forming mould to boxes with different depths or heights, both because of the cross support fixed to the frame of the mould and because the plate support must in any case be removed and replaced in its entirety. Furthermore the complexity and large number of the components of the forming mould as well as the arrangement of the plate support with integral channels for the suction means, make the said known forming assembly extremely expensive and complicated.

The object of the present invention is to avoid these disadvantages and to provide a forming assembly of the type defined above which on the one hand has a simpler and cheaper arrangement than known assemblies and on the other may conveniently and easily be adapted to the assembly of boxes of different shapes and dimensions, not only in width and length but also in height. In order to achieve this object, the present invention provides a forming assembly for automatic machines of the type defined at the beginning, characterised in that:

(a) the shaped segments in the forming mould have a shape substantially identical with each other and are carried by respective longitudinal shafts fixed to the said longitudinal bars; the transverse elements comprising forming rollers rotatably and adjustably supported by two transverse shafts carried by the transverse bars in positions overlying the said shafts carrying the presser rollers; the two opposite sides of the base frame being provided with members for attaching the frame to the machine and the central part of the frame being open; means being provided for adjusting the height of the longitudinal shafts relative to the longitudinal bars and means being provided for adjusting the height of the transverse shafts carrying the presser rollers as well as the transvese shafts carrying the forming rollers;

(b) the plate support the sprung feet are supported by substantially channel-section modular blocks fixed removably to the sides of the support sheet, and on one face, the support slab has a system of external pneumatic tubing connectible to a vaccum source and communicating with a plurality of suction members projecting from its opposite face.

By virtue of this characteristic, the forming assembly of the invention is considerably simpler and cheaper to make than known forming assemblies. Moreover, it can be adapted relatively easily and quickly to boxes of different dimensions, even different heights, and by virtue of the presence of the adjusting means together with the conformation of its base frame it may to advantage be used for the forming of boxes having a considerable height or depth.

Figure 2:
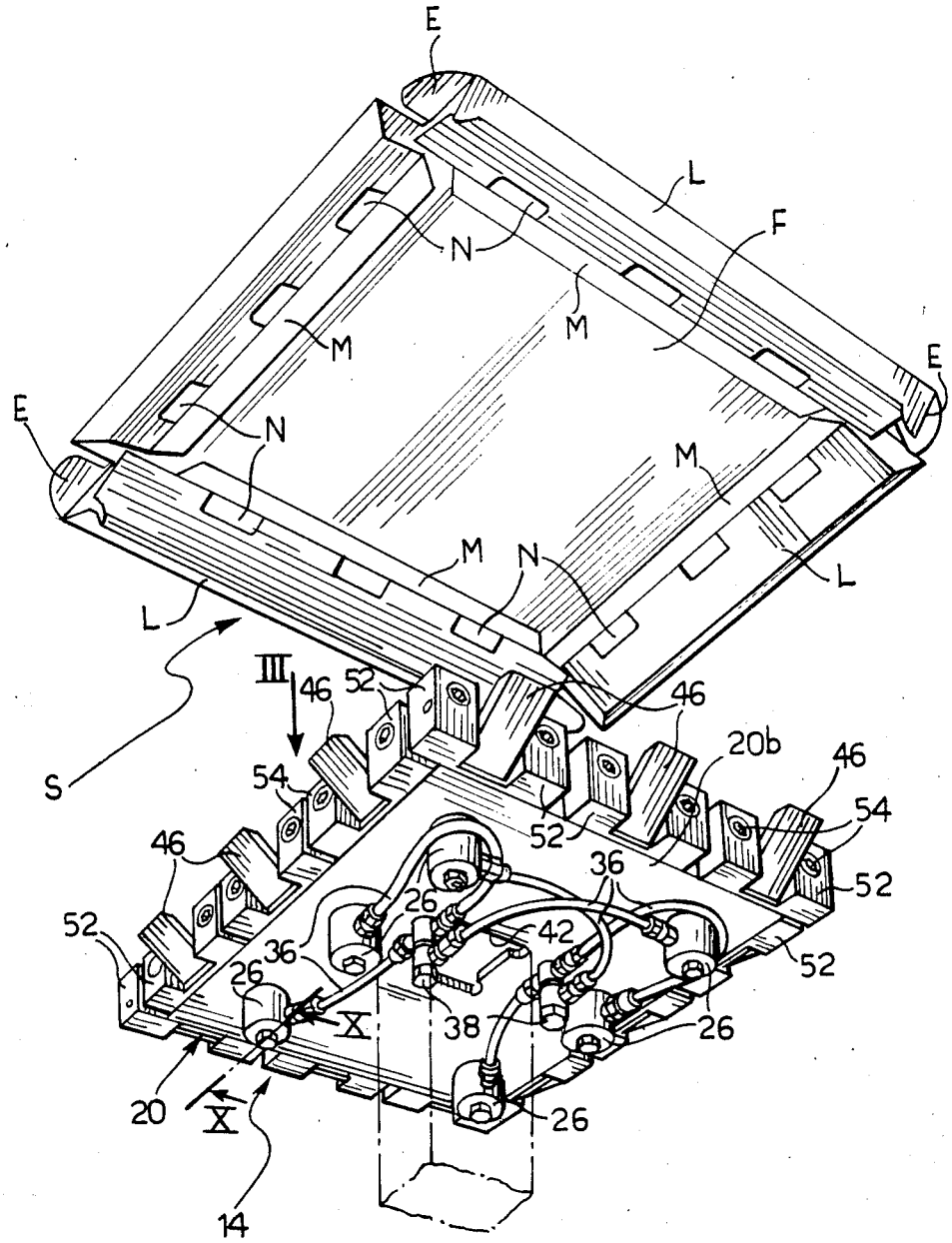
Figure 3:
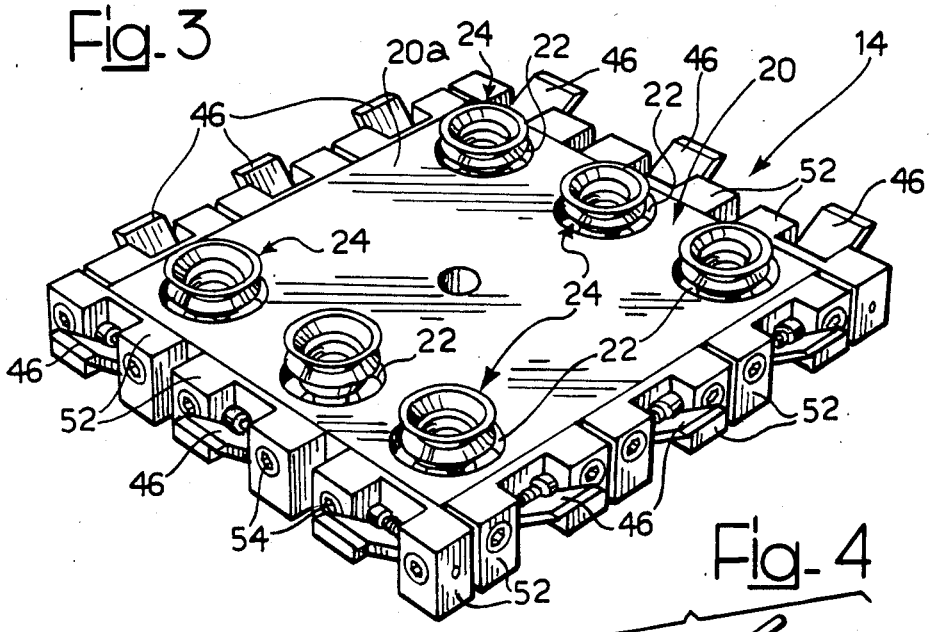
Figure 4:
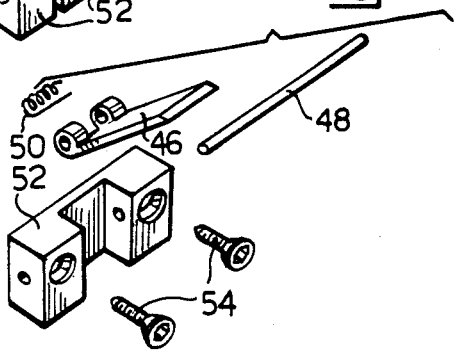
Figure 10:
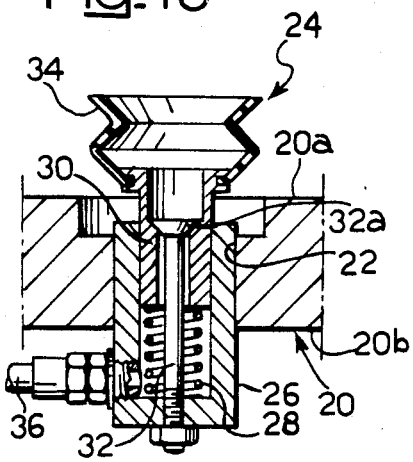
Figure 9:
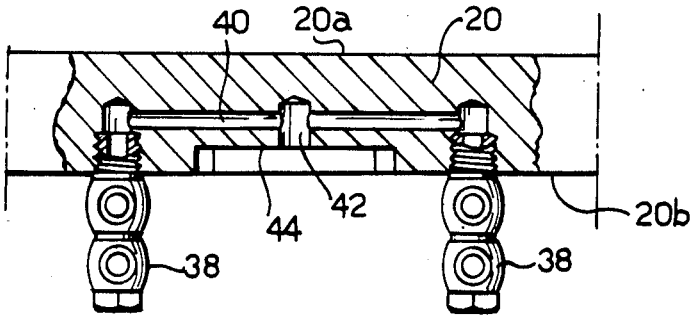
Figure 5:
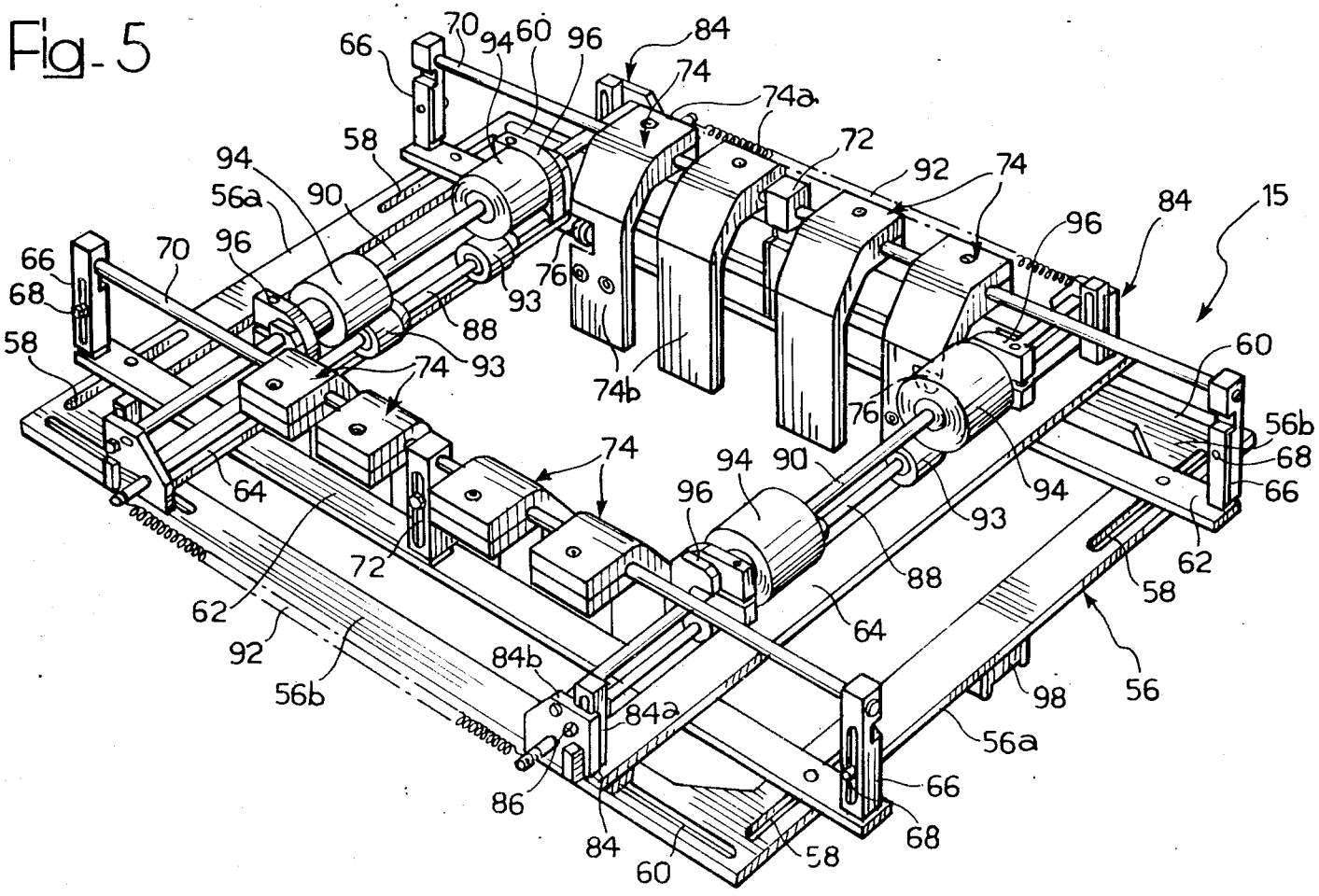
Figure 6:
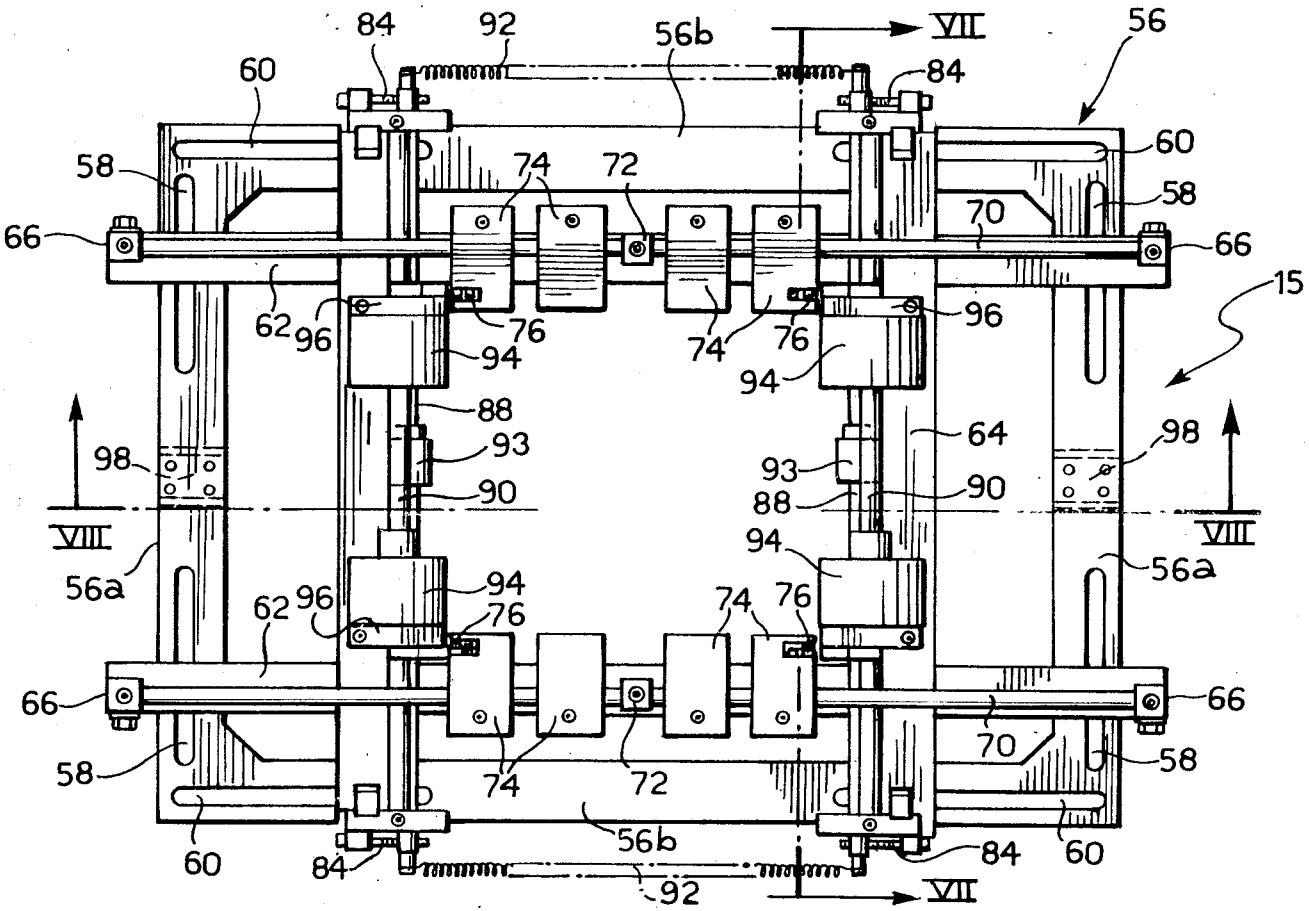
Figure 7:
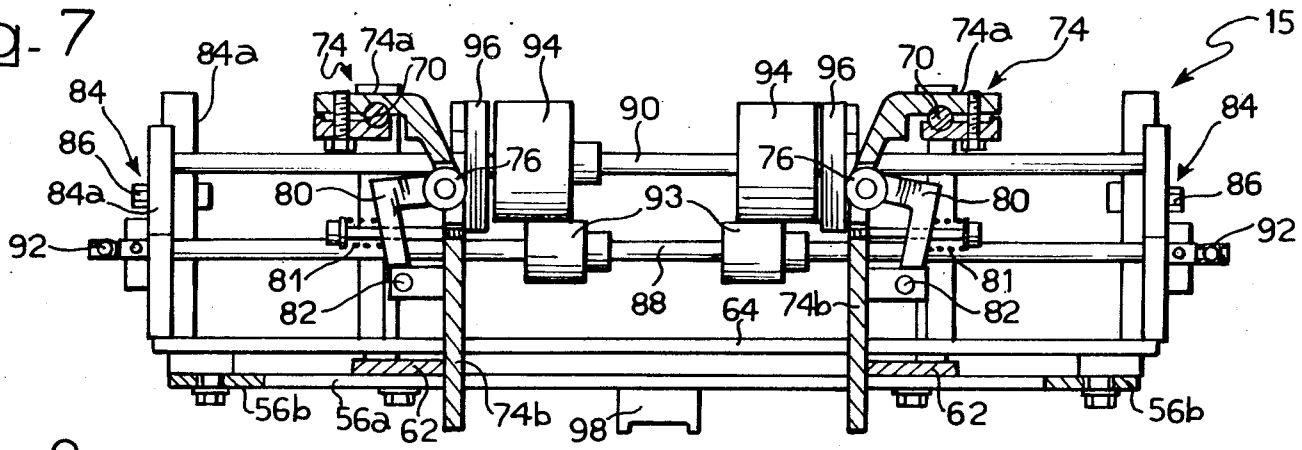
Figure 8:
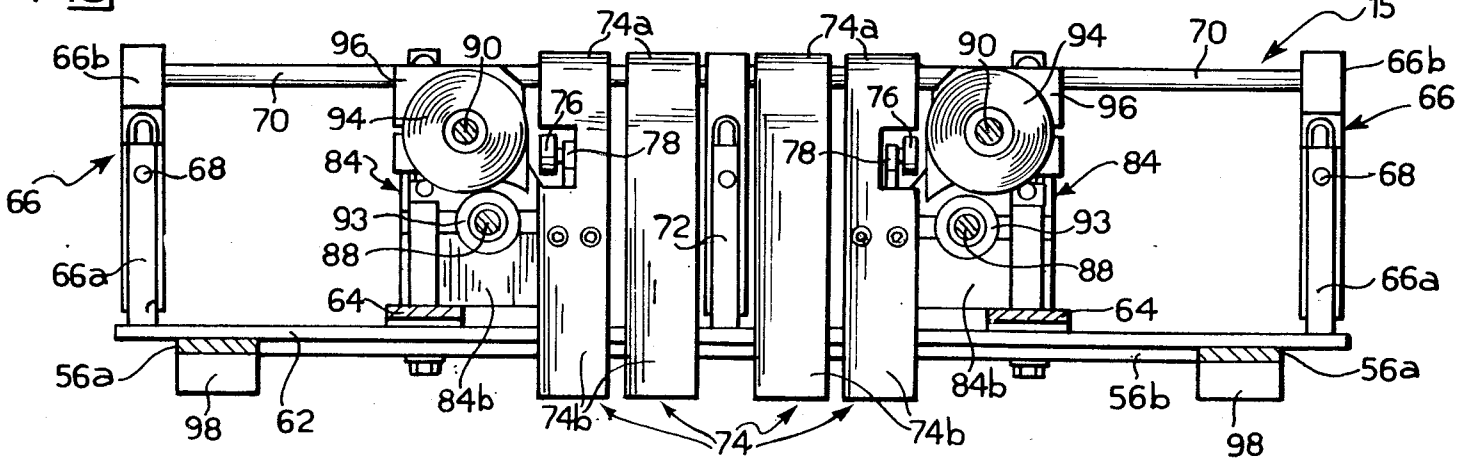

The invention will now be described in detail with reference to the appended drawings, provided purely by way of non-limiting example, in which:

FIG. 1 is a schematic, broken-away perspective view of an automatic machine for forming boxes provided with a forming assembly according to the invention, FIG. 2 is an exploded perspective view of a component of the forming assembly and of a box adapted to be assembled by means of this forming assembly, FIG. 3 is a perspective view of the component of FIG. 2 viewed from a different angle, FIG. 4 is an exploded view of a detail of FIG. 3, FIG. 5 is a perspective view of another component of the forming assembly, FIG. 6 is a plan view of FIG. 5 from above, FIG. 7 is a cross sectional view on an enlarged scale taken on the line VII—VII of FIG. 6, FIG. 8 is a longitudinal sectional view taken on line VIII—VIII of FIG. 6, and FIGS. 9 and 10 are two sections, on an enlarged scale, taken along the lines IX—IX and X—X respectively of FIG. 2.

FIG. 1 is a schematic, broken-away view of the operative part of an automatic machine for forming boxes. The machine, for example of the Schubert SKA type, comprises in known manner a cross rotor 10 rotatable about a horizontal shaft 12, the arms of the rotor carrying a series of four identical plate supports 14 movable angularly in angular steps of 90° between a withdrawal station, a forming station and a discharge station indicated generally A, B and C respectively.

The withdrawal station A comprises, in known manner, a magazine 16 carrying a stacked pile of semi-finished flat cards S intended to form the boxes, which are taken individually from the bottom of the pile, in known manner, by means of plate supports 14 and transferred to the forming station B. As illustrated in detail in FIG. 2, each flat semi-finished card S comprises essentially a punched rectangular sheet bent to form a base wall F and four side walls L lying flat in the plane of the bottom F and each including a series of bent flaps intended, in the erect, assembled condition of the box when these flaps are bent at right angles and raised relative to the bottom F, to form a tubular or box-section frame. These side walls L have frontal tabs M glued to the bottom F and are equipped with frontal apertures N. Moreover two opposite side walls L have lateral end tongues E for insertion and gluing within the ends of the other two side walls L to ensure the stability of the box when assembled.

The forming station B includes a forming mould generally indicated 15 which forms a forming assembly with the plate support 14 when located from time to time at the forming station B, which forming assembly erects and assembles the side walls L of the flat semi-finished pieces S. The forming mould 15 is movable relative to the plate support 14 brought to the forming station B so as to be able to approach and subsequently move away from the plate support 14 by means of a conventional drive system.

The discharge station C always includes, in known manner, a discharge device 17 arranged to separate the boxes formed from time to time at the forming station B and transferred by the plate supports 14 to the station C.

The separating member 17 is driven in known manner in synchronism with the movement of the forming mould 15 and for this purpose it is usually connected to the latter by horizontal bars 18.

With reference now in greater detail to FIGS. 2 to 4 and 9 and 10, the structural characteristics of one of the plate supports 14 will now be described.

This plate support 14 includes a rectangular metal slab 20 having a series of apertures 22 in each of which there is inserted a suction member 24. In the embodiment illustrated, there are six suction members 24 arranged along two opposite sides of the slab 20.

As is best seen in FIG. 10, each suction member 24 includes a cylinder 26 in which a bushing 30 is sealingly slidable against the action of a helical spring 28, the bush being connected to the bottom of the cylinder 26 by a bolt 32 and carrying a suction cup 34 at its top projecting from the upper face 20*a* of the slab 20. By virtue of this assembly, the suction cup 34 is able to slide relative to the cylinder 26 and hence to move inwardly of the slab 20 against the action of the spring 28. The bolt 32 has a flared head 32*a* which acts as a valve head for isolating the suction cup 34 from the suction system under the action of the spring 28, in the condition illustrated in FIG. 10, in order to prevent loss of suction in the system.

The cylinders 26 are connected to two groups of three flexible tubes 36 disposed on the exterior of the lower face 20*b* of the slab 20 and terminating at two manifolds 38 fixed to the face 20*b* and interconnected by a passage 40 formed within the slab 20. The passage 40 communicates with an aperture 42 formed in a central rebate 44 in the face 20*b* in which there is fixed the end of the arm of the cross rotor 10 to which the plate support 14 is fixed.

A plurality of sprung feet 46 are attached to the four sides of the slab 20 for cooperating in known manner with the apertures N in the side walls L of the semi-finished product S during formation of the boxes.

As is best illustrated in FIGS. 3 and 4, each sprung foot 46 is constituted by a plate supported for rotation on a shaft 48 against the action of a pin spring 50. The shaft being carried by a channel-section modular block 52 releasably fixed by means of a pair of screws 54 to the slab 20. This characteristic, as well as considerably simplifying the manufacture of the plate support 14, allows the machine to be adapted easily to the assembly of boxes of different sizes.

With reference now to FIGS. 5 to 8, the forming mould 15 includes a rectangular base frame 56 the two shorter sides 56*a* whereof have elongate slots 58 close to their ends and the two longer sides 56*b* whereof have elongate slots 60 close to their ends.

Two pairs of longitudinal and transverse bars, indicated 62, 64 respectively, are connected to the base frame 56. The connection of both pairs of bars is achieved by means of simple bolts engaged, for the longitudinal bars 62, in the slot 58 of the shorter sides 56*a* of the frame 56 and, for the transverse bars 64, in the slot 60 in the longer sides 56*b* of the frame 56. Thus the bars 62 and 64 may easily be moved and adjusted relative to the frame 56 in order to vary the width and length of the operative zone of the forming mould 15 defined in a manner clarified below.

The ends of the two longitudinal bars 62 carry respective pairs of pillar supports 66 each of which is constituted, as is best seen in FIG. 8, by two prismatic parts, lower part 66*a* and upper part 66*b* respectively, slidably coupled together by means of screw clamping members 68. This construction in practice enables adjustment of the height of the pillar supports 66 the upper part 66*b* whereof carry a pair of longitudinal shafts 70 extending parallel to and above the longitudinal bars 62.

The longitudinal shafts 70 are connected at their middles to the longitudinal bars 62 by means of a pair of pillar supports 72 entirely similar to the pillar supports 66 and carry respective shaped segments indicated 74 intended to constitute the longitudinal walls of the mould 15.

The segments 74, of which there are four for each of the longitudinal shafts 70 in the embodiment illustrated, all have the same shape and include a root portion 74*a* for clamping in an adjustable manner to the respective shaft 70 and an elongate shaped part 74*b* extending forwardly beneath the longitudinal bars 62.

The two end segments 74 of each of the two series carried by the shafts 70 are each associated with a roller 76 projecting from a recess 78 in the part 74*b* and carried by a cranked lever 80 pivotable, against the action of a helical return spring 81, about a pin 82 supported by the inner face of the part 74*b*.

The two transverse bars 64 carry respective pairs of pillar supports 84 at their ends, these having configurations similar to the pillar supports 66 for the longitudinal bar 62. In effect, as is best seen in FIG. 7, each pillar support 84 includes two prismatic bodies 84*a*, 84*b*, slidably coupled together and interconnected by means of a screw locking member 86. More particularly, the bodies 84*a* are fixed to the transverse bars 64 while the bodies 84*b* are constituted by brackets carrying two pairs of transverse shafts, lower ones 88 and upper ones 90 respectively extending parallel to the transverse bar 64.

The two lower shafts 88 are slidable within slots in the brackets 84*b* so as to be able to move away from each other parallel to the longitudinal bar 62 against the action of a pair of helical traction springs 92, and rotatably support respective presser rollers 93.

The transverse shafts 90 are instead connected rigidly at their ends to the respective brackets 84*b* and each support a pair of forming rollers 94 the position of which is adjustable. The two forming rollers 94, together with two pairs of shaped segments 96 carried by the shafts 90 adjacent the outermost shaped segements 74 of the two series carried by the shafts 70, define the transverse walls of the mould 15.

By virtue of the arrangement described above, the forming mould 15 may be adapted relatively simply and easily to the forming of boxes of different shapes and dimensions, not only in width and length but also in height.

In effect, it is the conformation of the pillar support 66, 72 and 84 which enables the height of the transverse walls (defined as stated by the segments 74) and the longitudinal walls (defined by the rollers 94 and by the sectors 96) of the mould 15 to be varied, and this indeed allows the use of the mould for moulding boxes of different depths. These depths may be considerable and in any case considerably greater than that which may be achieved with conventional forming moulds, by virtue of the fact that the central zone of the frame 56 is in practice free, this zone being delimited by the elements defining the longitudinal walls and the transverse walls of the mould. This is due to the fact that the connection of the forming mould 15 to the drive mechanisms of the forming machine is achieved by means of a simple pair of attachments 98 fixed to the middles of the shorter sides 56*a* of the base frame 56.

Naturally, the constructional details and embodiment may be varied widely with respect to that described and illustrated without thereby departing from the scope of the present invention.

What is claimed is:

1. In a forming assembly for automatic machines for forming boxes from semi-finished flat blanks each comprising a bottom panel and side walls, comprising a forming station, means for withdrawing one of the blanks from the bottom of a stack in a magazine and for transferring the blank to said forming station, said withdrawing and transferring means comprising a plate support, said forming station including a forming mould defining means cooperating with said plate support for erecting the side walls of the blank relative to the bottom panel during relative motion between said plate support and said forming mould, the plate support including a rectangular support slab to the sides of which are fixed sprung feet for cooperating with the bottom panel of the semi-finished blank during the forming of the box, the forming mould including a rectangular base frame carrying two longitudinal bars supporting shaped segments forming the longitudinal walls of the mould, the longitudinal bars being adjustable transversely of the frame and the shaped segments being adjustable along the longitudinal bars, and two transverse bars carrying elements forming the side walls of the mould and a first two transverse shafts carrying respective presser rollers, resilient biassing means associated with said presser rollers for resisting movement of said presser rollers away from each other, the transverse bars and the transverse shafts being adjustable longitudinally of the frame, the longitudinal and transverse directions being generally mutually orthogonal with the direction of said relative motion between said plate support and said forming mould, the improvements wherein said shaped segments in said forming mould have a shape substantially identical with each other and are carried by longitudinal shafts respectively fixed to said longitudinal bars; said side wall forming elements comprise forming rollers rotatably and adjustably supported by a second two transverse shafts carried by the transverse bars in positions overlying said first two transverse shafts carrying the presser rollers; the two opposite sides of said base frame are provided with members for attaching the frame to the machine, the central part of the frame being open; means are provided for adjusting the height of the longitudinal shafts relative to the longitudinal bars and means are provided for adjusting the height of the transverse shafts carrying the presser rollers and for adjusting the height of the transverse shafts carrying the forming rollers relative to the transverse bars; said sprung feet in said plate support are supported by substantially channel-section modular blocks fixed removably to the sides of the support slab and the support slab has on one face a system of external pneumatic tubing connectible to a vacuum source and communicating with a plurality of suction members projecting from the opposite face of the support slab the height direction being generally parallel with the direction of said relative motion between said plate support and said forming mould.

2. Forming assembly according to claim 1, wherein said shaped segments have root parts for clamping to the longitudinal shafts and elongate parts which extend beneath the said longitudinal bars.

3. Forming assembly according to claim 1, wherein said height-adjusting means comprise pillar supports of adjustable length, which connect the longitudinal and transverse bars respectively to said longitudinal shafts and said transverse shafts.

4. Forming assembly according to claim 1, wherein said suction members include cylinders connected to the said system of external pneumatic tubing and in which there are sealingly slidable, against the action of resilient biassing means, support bushings carrying respective suction cups which are perpendicularly movably mounted to the support slab of the plate support.

5. Forming assembly according to claim 4, wherein said suction members have associated valve means for cutting off the communication between the suction cups and the system of tubing under the action of the resilient biassing means.

* * * * *